US007126539B2

(12) United States Patent
Li et al.

(10) Patent No.: US 7,126,539 B2
(45) Date of Patent: Oct. 24, 2006

(54) NON-UNIFORM DIELECTRIC BEAM STEERING ANTENNA

(75) Inventors: Qian Li, Ann Arbor, MI (US); Wladimiro Villarroel, Worthington, OH (US)

(73) Assignee: AGC Automotive Americas R&D, Inc., Ypsilanti, MI (US)

( * ) Notice: Subject to any disclaimer, the term of this patent is extended or adjusted under 35 U.S.C. 154(b) by 98 days.

(21) Appl. No.: 10/985,167

(22) Filed: Nov. 10, 2004

(65) Prior Publication Data

US 2006/0097923 A1 May 11, 2006

(51) Int. Cl.
*H01Q 1/38* (2006.01)
*H01Q 1/32* (2006.01)

(52) U.S. Cl. ..... 343/700 MS; 343/713

(58) Field of Classification Search ..... 343/700 MS, 343/711, 712, 713, 704, 846, 848
See application file for complete search history.

(56) References Cited

U.S. PATENT DOCUMENTS 4,914,445 A 4/1990 Shoemaker
5,099,249 A 3/1992 Seavey
5,155,493 A 10/1992 Thursby et al.
5,194,876 A 3/1993 Schnetzer et al.
5,448,250 A 9/1995 Day
5,565,875 A 10/1996 Buralli et al.
5,633,645 A * 5/1997 Day ..... 343/700 MS
5,646,637 A 7/1997 Miller
5,870,057 A 2/1999 Evans et al.
5,872,542 A 2/1999 Simons et al.
5,898,407 A 4/1999 Paulus et al.
5,905,471 A 5/1999 Biebl et al.
5,995,047 A 11/1999 Freyssinier et al.
6,121,931 A 9/2000 Levi
6,225,958 B1 * 5/2001 Amano et al. ..... 343/767
6,281,845 B1 8/2001 Ittipiboon et al.
6,307,509 B1 10/2001 Krantz
6,384,785 B1 5/2002 Kamogawa et al.
6,417,811 B1 7/2002 Adrian
6,552,696 B1 4/2003 Sievenpiper et al.
6,661,386 B1 12/2003 Petros et al.

(Continued)

FOREIGN PATENT DOCUMENTS

DE 298 24 990 2/2004

(Continued)

OTHER PUBLICATIONS

"SDAR—Antennas: Environmental Influences, Measurement, Vehicle Application Investigations and Field Experiences" Auth: Daginnus et al.., SAE World Cong. Mar. 4-7, 2002.

(Continued)

*Primary Examiner*—Hoanganh Le
(74) *Attorney, Agent, or Firm*—Howard & Howard Attorneys, P.C.

(57) ABSTRACT

A microstrip antenna for receiving an RF signal from a satellite includes a radiation element and a ground plane disposed substantially parallel to and spaced from the radiation element. A first dielectric and a second dielectric are sandwiched between the ground plane and the radiation element, in a side-by-side relationship. The first dielectric has a first relative permittivity and the second dielectric has a second relative permittivity different from the first relative permittivity. A feed line electrically connects the antenna to an amplifier. A section of the feed line is disposed between the first and second dielectrics. The antenna produces the effect of tilting a radiation beam from a higher to a lower elevation angle to achieve a higher gain at lower elevation angles.

56 Claims, 6 Drawing Sheets

U.S. PATENT DOCUMENTS

| | | | | |
|---|---|---|---|---|
| 6,720,926 | B1 | 4/2004 | Killen et al. | |
| 6,750,820 | B1 | 6/2004 | Killen et al. | |
| 6,750,823 | B1 * | 6/2004 | Turnbull et al. | 343/713 |
| 6,970,137 | B1 * | 11/2005 | Maslovski et al. | 343/702 |
| 2002/0036593 | A1 | 3/2002 | Ying | |
| 2002/0070900 | A1 | 6/2002 | Phelan | |
| 2004/0008140 | A1 | 1/2004 | Sengupta et al. | |
| 2004/0090369 | A1 | 5/2004 | McCarrick | |
| 2004/0155825 | A1 * | 8/2004 | Komatsu et al. | 343/713 |
| 2004/0178961 | A1 | 9/2004 | Maeuser et al. | |
| 2005/0195114 | A1 | 9/2005 | Yegin et al. | |
| 2005/0195115 | A1 | 9/2005 | Yegin et al. | |

FOREIGN PATENT DOCUMENTS

| | | |
|---|---|---|
| EP | 1 088 365 B1 | 2/2004 |
| WO | WO 01/73890 | 10/2001 |

OTHER PUBLICATIONS

PCT International Search Report, International Application No. PCT/US2005/018795, International Filing date May 27, 2005, 5 pages.

* cited by examiner

NON-UNIFORM DIELECTRIC BEAM STEERING ANTENNA

BACKGROUND OF THE INVENTION

1. Field of the Invention

The subject invention relates to an antenna, specifically a microstrip patch antenna, for receiving a circularly polarized radio frequency (RF) signal from a satellite.

2. Description of the Related Art

Satellite Digital Audio Radio Service (SDARS) providers use satellites to broadcast RF signals, particularly circularly polarized RF signals, back to Earth. SDARS providers use multiple satellites in a geostationary orbit or in an inclined elliptical constellation. The elevation angle between the respective satellite and the antenna is variable depending on the location of the satellite and the location of the antenna. Within the continental United States, this elevation angle may be as low as 20°. Accordingly, specifications of the SDARS providers require a relatively high gain at elevation angles as low as 20°.

Various microstrip antennas for receiving an RF signal are well known in the art. One example of such an antenna is disclosed in the U.S. Pat. No. 5,870,057 (the '057 patent) to Evans et al.

The '057 patent discloses an antenna for receiving or transmitting an RF signal. The antenna includes a radiation element and ground plane spaced from each other. A first dielectric having a first relative permittivity is supported by the ground plane. A second dielectric having a second relative permittivity is supported by the first dielectric. The second relative permittivity is equal to the square root of the first relative permittivity. The radiation element has a generally rectangular shape and is disposed within or between one of the dielectrics. Due to the integration of the radiation element and the dielectrics, the radiation element has a length shorter than that of other antennas, thus reducing the overall size of the antenna. The beam radiation of the antenna of the '057 patent is directed normal to the plane in which the radiation element lies. However, the antenna of the '057 patent does not aid in the reception of the RF signal from a satellite at a relatively low elevation angle, unless the antenna structure is physically oriented such that the antenna beam is directed towards the satellite.

To date, the performance of antennas integrated with automotive glass in receiving SDARS signals has been disappointing. In particular, these antennas have failed to produce radiation beams that are not normal to the pane of glass. Therefore, there remains an opportunity to introduce an antenna that aids in the reception of the RF signal from a satellite. Specifically, there remains an opportunity for an antenna that aids in reception of the RF signal from elevation angles as low as 20°.

SUMMARY OF THE INVENTION AND ADVANTAGES

The invention provides an antenna including a radiation element having a first region and a second region. A ground plane is disposed substantially parallel to and spaced from the radiation element. A first dielectric, having a first relative permittivity, is sandwiched between the first region and the ground plane. A second dielectric, having a second relative permittivity different from the first relative permittivity, is sandwiched between the second region and the ground plane.

The structure of the antenna produces a directional radiation beam with a highest gain portion at a certain elevation angle. Due to the difference between the relative permittivity of the dielectrics, the radiation beam tilts from a higher to a lower elevation angle, thus tilting the highest gain portion accordingly. This tilt is particularly important when receiving an RF signal broadcast from a satellite of a Satellite Digital Audio Radio Service (SDARS) provider. Specifications of the SDARS providers require a relatively high gain at elevation angles as low as 20°. The antenna of the subject invention produces a relatively high gain of the RF signal even at these low elevation angles.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE PREFERRED EMBODIMENT

Figure 1:
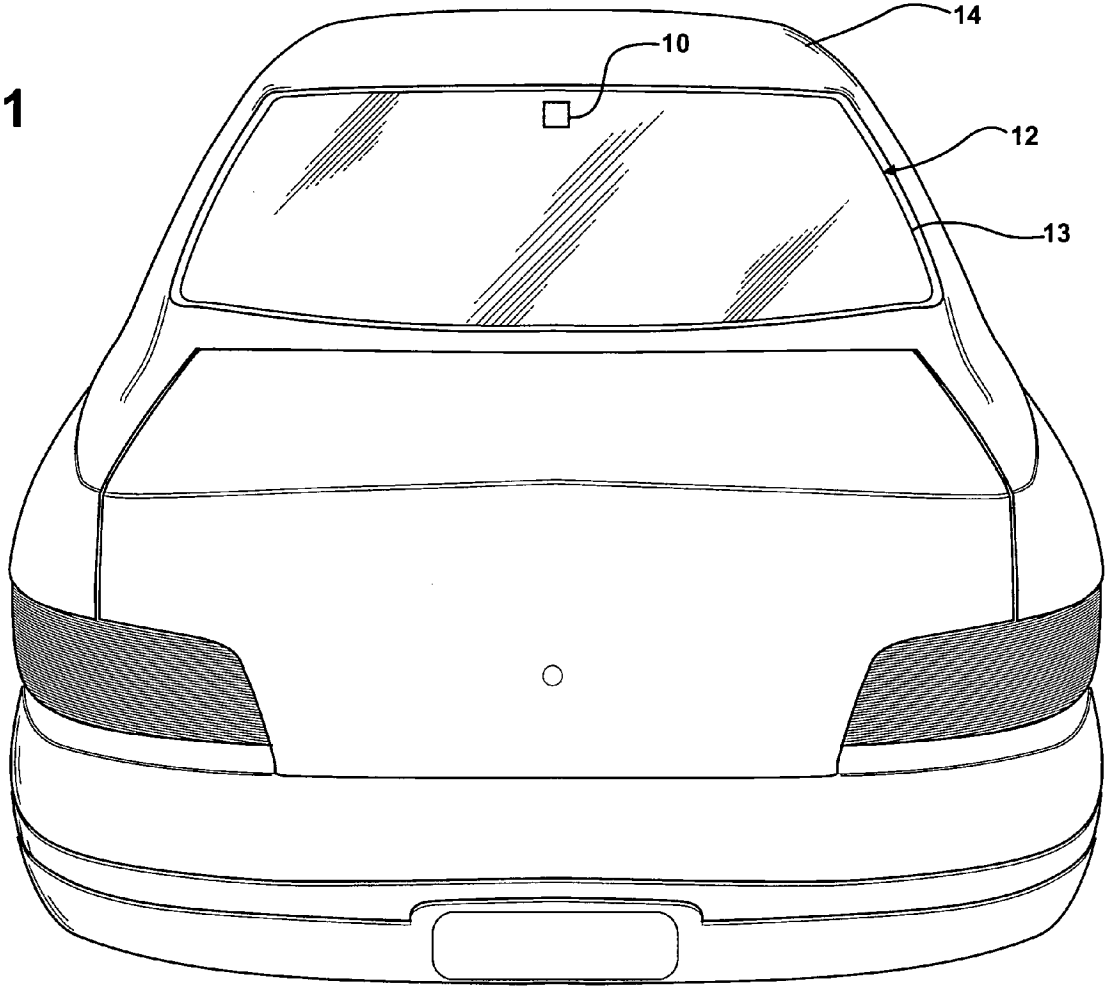
FIG. 1 is a perspective view a vehicle with an antenna supported by a pane of glass of the vehicle.

Referring to the Figures, wherein like numerals indicate corresponding parts throughout the several views, an antenna is shown generally at 10 in FIG. 1. In the preferred embodiment, the antenna 10 is utilized to receive a circularly polarized radio frequency (RF) signal from a satellite. Those skilled in the art realize that the antenna 10 may also be used to transmit the circularly polarized RF signal. Specifically, the antenna 10 receives a left-hand circularly polarized (LHCP) RF signal like those produced by a Satellite Digital Audio Radio Service (SDARS) provider, such as XM® Satellite Radio or SIRIUS® Satellite Radio. However, it is to be understood that the antenna 10 may also receive a right-hand circularly polarized (RHCP) RF signal. Furthermore, the antenna 10 may be alternately configured to transmit or receive a linear polarized RF signal.

Referring to FIG. 1, the antenna 10 is preferably integrated with a window 12 of a vehicle 14. This window 12 may be a rear window (backlite), a front window (windshield), or any other window of the vehicle 14. Those skilled in the art realize that the antenna 10 as described herein may be located at other positions on the vehicle 14, such as on a sheet metal portion like the roof of the vehicle. The antenna 10 may also be implemented in other situations completely separate from the vehicle 14, such as on a building or integrated with a radio receiver.

The window 12 includes at least one pane of glass 13. The pane of glass 13 is preferably automotive glass and more preferably soda-lime-silica glass, which is well known for use in panes of glass 13 of vehicles 14. The pane of glass 13 functions as a radome to the antenna 10. That is, the pane of glass 13 protects the other components of the antenna 10, as described in detail below, from moisture, wind, dust, etc. that are present outside the vehicle 14. The pane of glass defines a thickness between 1.5 and 5.0 mm, preferably 3.1 mm. The pane of glass also has a relative permittivity between 5 and 9, preferably 7. Of course, the window 12 may include more than one pane of glass 13. Those skilled in the art realize that automotive windows 12, particularly windshields, include two panes of glass 13 sandwiching a layer of polyvinyl butyral (PVB).

Figure 2:
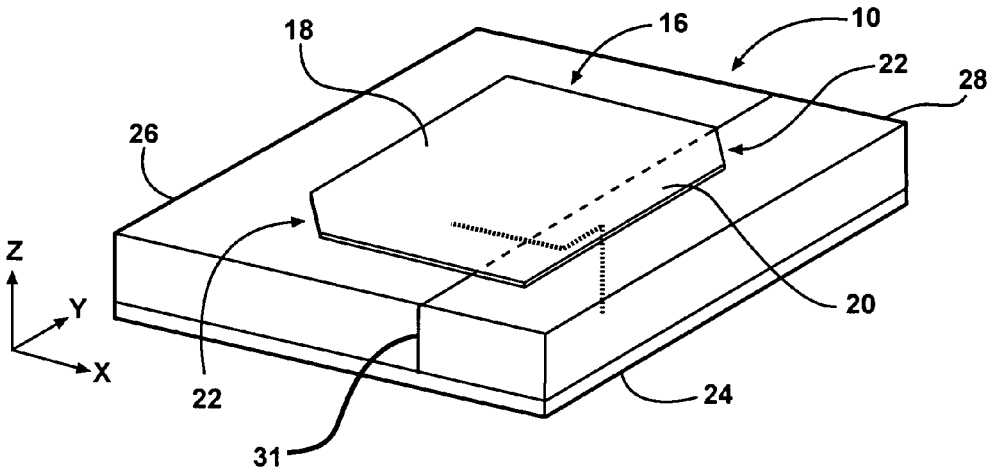
FIG. 2 is a perspective view of the antenna showing a radiation patch, a first dielectric, a second dielectric, a ground plane, and a feed line.

Referring now to FIG. 2, the antenna 10 includes a radiation element 16 formed of an electrically conductive material described additionally below. The radiation element 16 is also commonly referred to by those skilled in the art as a "patch" or a "patch element". The radiation element 16 is divided into a first region 18 and a second region 20. It is understood that the first 18 and second regions 20 are hypothetical regions used herein merely for describing the relationship between the radiation element 16 and other components of the antenna 10. Typically, the first and second regions 18, 20 are indistinguishable in composition and material from one another. In the preferred embodiment, the radiation element defines a total area. In the preferred embodiment, the first region 18 comprises 70–90% of the total area and the second region 20 comprises 10–30% of the total area. More preferably, the first region 18 comprises about 80% of the total area and the second region 20 comprises about 20% of the total area. FIG. 2 does not include the pane of glass 13 because the antenna 10 of the present invention can operate with or without the pane of glass 13. However, it is to be understood that the preferred embodiment does include the pane of glass 13.

The radiation element 16 of the preferred embodiment defines a generally rectangular shape, specifically a square shape. Each side of the radiation element 16 measures about one-quarter of a wavelength $\lambda$ of the RF signal to be received by the antenna 10. RF signals transmitted by SDARS providers typically have a frequency from 2.32 GHz to 2.345 GHz. These frequencies translate into wavelengths $\lambda$ from 128 to 129 mm. Therefore, each side of the radiation element 16 measures about 31–33 mm, preferably about 32 mm. However, those skilled in the art realize alternative embodiments where the radiation element 16 defines alternative shapes and sizes depending on the type and frequency of the signal to be received or transmitted.

The radiation element 16 of the preferred embodiment also includes a pair of perturbation truncations 22. The perturbation truncations 22 are defined at opposite corners of the radiation element 16. The perturbation truncations 22 are "cut-outs" of the opposite corners. The perturbation truncations 22 provide the radiation element 16 with a circular polarization to receive the circularly polarized RF signal from the satellite. Those skilled in the art realize that other techniques of generating circular polarization may be implemented, including, but not limited to, the use of a circular patch with an added trim tab or a 45 degree offset feed.

Figure 3:
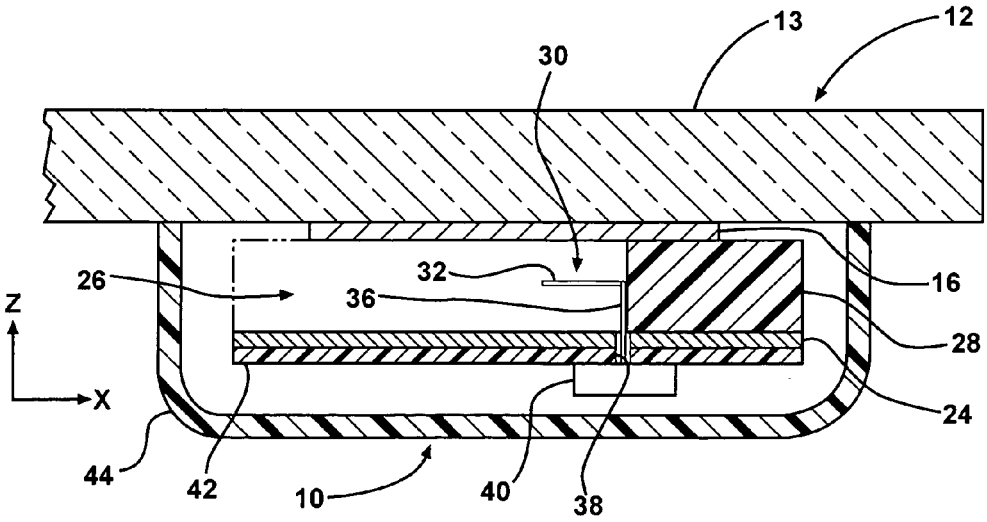
FIG. 3 is a partial cross sectional view of a preferred embodiment of the antenna with the radiation element disposed on the pane of glass.

In the preferred embodiment, as shown in FIG. 3, the pane of glass 13 of the window 12 supports the radiation element 16. The pane of glass 13 supports the radiation element 16 by the radiation element 16 being adhered, applied, or otherwise connected to the pane of glass 13. Preferably, the radiation element 16 comprises a silver paste as the electrically conductive material disposed directly on the pane of glass 13 and hardened by a firing technique known to those skilled in the art. Alternatively, the radiation element 16 could comprise a flat piece of metal, such as copper or aluminum, adhered to the pane of glass 13 using an adhesive.

The antenna 10 also includes a ground plane 24 formed of an electrically conductive material. The ground plane 24 is disposed substantially parallel to and spaced from the radiation element 16. It is preferred that the ground plane 24 also defines a generally rectangular shape, specifically a square shape. In the preferred embodiment, the ground plane 24 measures about 40 mm×40 mm. However, the ground plane 24 may be implemented with various shapes and sizes.

As is understood by those skilled in the art, an electromagnetic field is excited between the radiation element 16 and the ground plane 24. This electromagnetic field reacts according to numerous factors. One of those factors is a relative permittivity of a material, typically referred to as a dielectric, disposed between the radiation element 16 and the ground plane 24.

The dielectric of the antenna 10 of the subject invention more specifically includes a first dielectric 26 and a second dielectric 28. The first dielectric 26 is sandwiched between the first region 18 of the radiation element 16 and the ground plane 24. Likewise, the second dielectric 28 is sandwiched between the second region 20 of the radiation element 16 and the ground plane 24. Of course, the dielectrics 26, 28 may be sandwiched between the radiation element 16 and the ground plane 24 without being in direct contact with the radiation element 16 and/or the ground plane 24. Furthermore, the dielectrics 26, 28 may extend beyond the areas defined by the radiation element 16 and the ground plane 24 so long as at least a portion of each dielectric 26, 28 is between the radiation element 16 and the ground plane 24.

In the preferred embodiment, the first dielectric 26 and the second dielectric 28 are disposed in a side-by-side relationship, such that the first dielectric 26 is disposed directly below the first region 18 and the second dielectric 28 is disposed directly below the second region 20. It is to be understood that although the dielectrics 26, 28 are in a side-by-side relationship with each other, one dielectric 26, 28 may be disposed to a certain extent above or below the other dielectric 28, 26 and still be in a side-by-side relationship.

Also in the preferred embodiment, the first dielectric 26 and the second dielectric 28 are disposed to be in contact with one another. Moreover, the first 26 and second dielectrics 28 are disposed to be in contact with the radiation element 16 and the ground plane 24. Specifically, the first dielectric 26 is in contact with the first region 18 of the radiation element 16 and the second dielectric 28 is in contact with the second region 20 of the radiation element 16. Those skilled in the art realize alternative embodiments where the first 26 and second dielectrics 28 may be spaced or separated from each other, from the radiation element 16, and/or from the ground plane 24. Furthermore, the two dielectrics 26, 28 do not have to be in perfect alignment with one another to be considered to be side-by-side.

The first dielectric 26 has a first relative permittivity. The second dielectric 28 has a second relative permittivity different from the first relative permittivity. The difference in relative permittivity between the first and second dielectrics 26, 28 causes the radiation beam to tilt from a higher to a lower elevation angle. This tilting allows the antenna 10 to produce a higher gain signal when the satellite is at a relatively low elevation angle with the antenna 10. Generally, the greater the difference in relative permittivity between the first and second dielectrics 26, 28, the higher the angle of tilting. However, it is to be understood that various configurations and/or arrangements of the radiation element 16 and the dielectric, i.e., the first and second dielectrics 26, 28, either side-by-side, or not side-by-side, can produce a radiation beam that is tilted offset of an axis normal to the radiation element 16.

A ratio of the second relative permittivity to the first relative permittivity may have a range from 100:1 to 1.1:1. Similarly, the ratio may be between 1:100 and 1:1.1, where the first relative permittivity is larger than the second relative permittivity. Preferably, the ratio has a range from 20:1 to 4:1 or 1:20 to 1:4. Most preferably, the ratio of second relative permittivity to the first relative permittivity is 9:1.

As stated above, the antenna 10 is preferably integrated with a window 12 of a vehicle 14. The window 12 may be mounted at a window elevation angle with respect to a horizontal and level ground. Therefore, the window elevation angle should be taken into consideration when determining the ratio of relative permittivity. The actual tilt angle of the beam of the antenna 10 is given by the contribution of the window elevation angle and the tilt angle provided by the ratio of relative permittivity.

In the preferred embodiment, the 9:1 ratio is accomplished by the first dielectric 26 having a first relative permittivity of 1 and the second dielectric 28 having a second relative permittivity of 9. The first dielectric 26 comprises air to achieve the first relative permittivity of 1. To achieve the second relative permittivity of 9, the second dielectric 28 preferably comprises silicone in an amount of 35 parts by weight, and titanium oxide in an amount of 65 parts by weight, based on 100 parts by weight of the second dielectric 28. However, those skilled in the art realize other methods for achieving the 9:1 ratio, or any other ratio of second relative permittivity to first relative permittivity.

Figure 4:
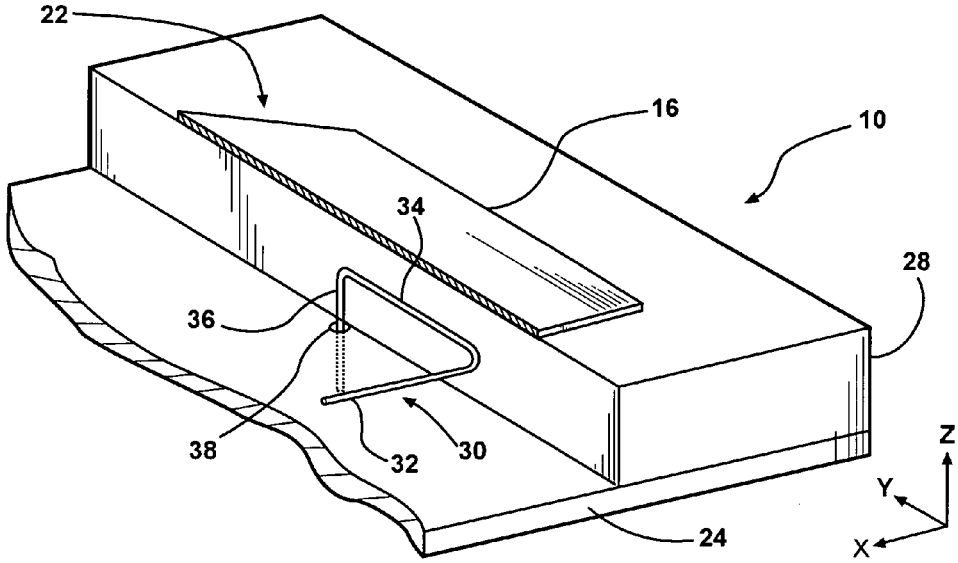
FIG. 4 is a perspective view of the antenna wherein the radiation element and ground plane are shown in cross-section to emphasize a shape of the feed line of the preferred embodiment.

The antenna 10 further includes a feed line 30 for providing an electrical connection to the radiation element 16. Referring to FIG. 4, a section of the feed line 30 is disposed at an interface 31 between the first dielectric 26 and the second dielectric 28. By positioning the section of the feed line 30 at the interface 31 between the first and second dielectrics 26, 28, the feed line 30 excites electric field components in two different media between the radiation element 16 and the ground plane 24 with a minimum effect caused by a discontinuity at the interface 31 between the two different dielectrics 26, 28. In addition, the electromagnetic fields radiated from the by edges of the radiation element 16 and the ground plane 24 will have a phase difference due to two factors. The first factor corresponds to the different path distance from the feed line 30 to the edges of the radiation element 16. The second factor is related to the different permittivity of the dielectrics 26, 28 in which the electric field components propagate from the feed line 30 to the edges of the radiation element 16. This phase difference in the radiated electromagnetic fields creates an antenna beam that is tilted as compared to the same type of antenna using a uniform dielectric between the radiation element 16 and the ground plane 24. In the preferred embodiment, the antenna 10 is aided in achieving a 10–20° tilt of the radiation beam, in addition to the window elevation angle. However, the exact location of the feed line 30 depends on both impedance and polarization characteristics of the specific antenna design for a given application.

Figure 5A:
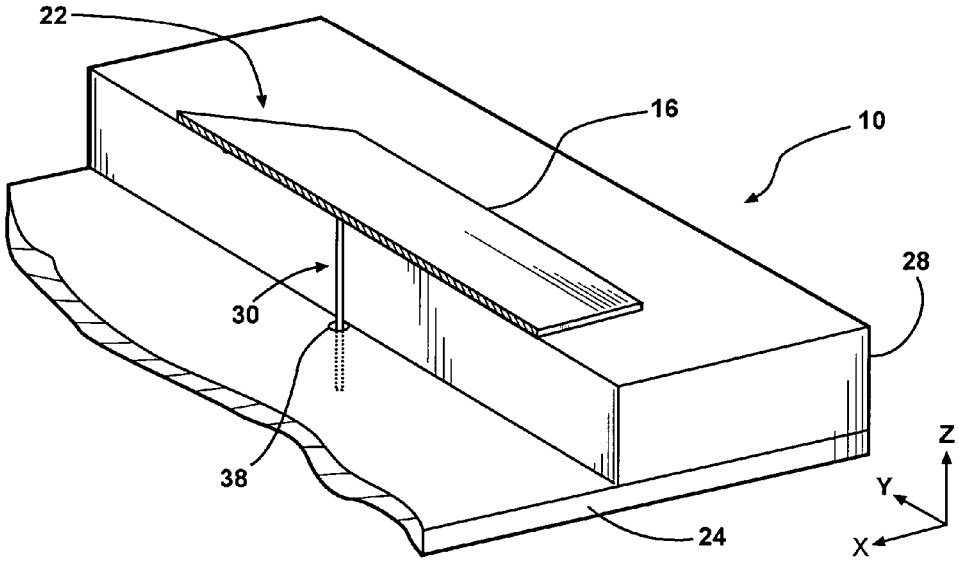
FIG. 5A is a perspective view of the antenna wherein the radiation element and ground plane are shown in cross-section to emphasize an alternative embodiment where the feed line is straight and in direct contact with the radiation element.
Figure 5B:
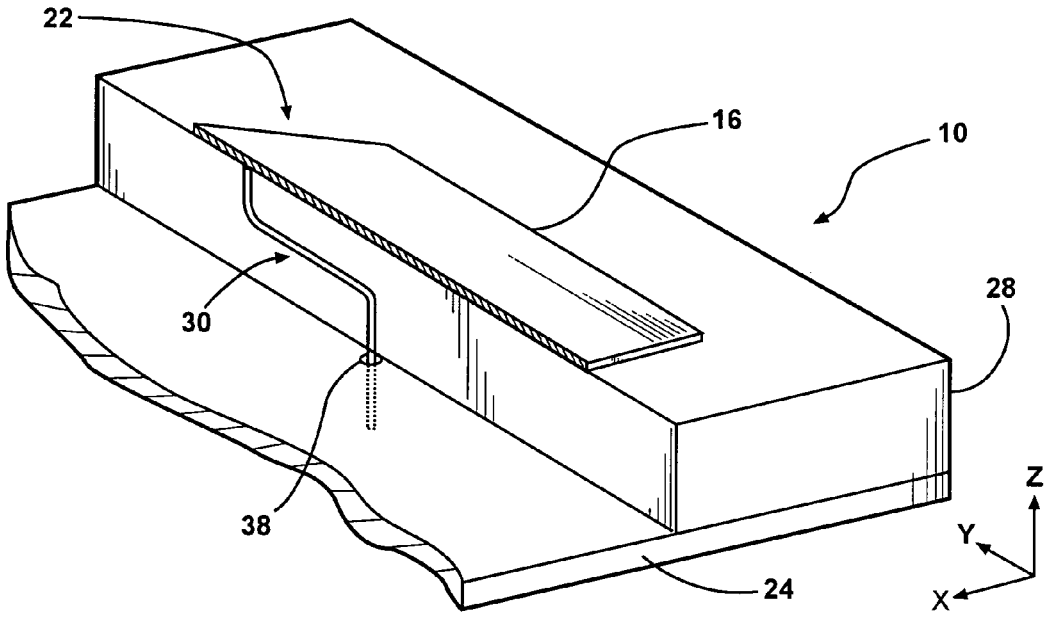
FIG. 5B is a perspective view of the antenna wherein the radiation element and ground plane are shown in cross-section to emphasize an alternative embodiment where the feed line is bent and in direct contact with the radiation element.

In the preferred embodiment, the feed line 30 is electromagnetically coupled to the radiation element 16; that is, the feed line 30 and radiation element 16 do not come into direct contact with one another. In alternative embodiments, as shown in FIGS. 5A and 5B, the feed line 30 may be directly connected to the radiation element 16. It is to be understood that the feed line 30 may be straight, as shown in FIG. 5A, or bent, as shown in FIG. 5B. The use of the bent feed line 30 allows adaptation to additional circuitry and/or certain packaging preferences relating, in part, to orientation of an amplifier 40, as described further below.

The feed line 30 is preferably formed of an electrically conductive wire. Referring again to FIG. 4, the feed line 30 of the preferred embodiment is shaped to define a first section 32, a second section 34, and a third section 36. The first section 32 is disposed within the first dielectric 26 and generally parallel to an X-axis. The second section 34 extends generally perpendicular from the first section 32 and is disposed between the first and second dielectrics 26, 28. The second section 34 is generally parallel to a Y-axis. The positioning of the second section 34 between the first and second dielectrics 26, 28 aids the antenna 10 in achieving the 10–20° tilt of the radiation beam. The third section 36 of the feed line 30 extends generally perpendicular from the second section 34 and is generally perpendicular to the first section 32. Thus, the third section is generally parallel to a Z-axis. It is preferred that the ground plane 24 defines a hole 38, and that the third section 36 of the feed line 30 protrudes through the hole 38.

As mentioned above, the antenna 10 also includes the amplifier 40 electrically connected to the feed line 30. The amplifier 40 amplifies the RF signal received by the antenna 10. The amplifier 40 is preferably a low-noise amplifier (LNA) such as those well known to those skilled in the art. A circuit board 42 is preferably electrically connected to the feed line 30 for supporting the amplifier 40. In the preferred embodiment, as shown in FIG. 3, the circuit board 42 is supported by the ground plane 24. A cover 44 may also be affixed to the pane of glass 13 to enclose the ground plane 24, the radiation element 16, and the first 26 and second dielectrics 28. The cover 44 protects the antenna 10 from dust, dirt, contaminants, accidental breakage, etc., as well as providing the antenna 10 with a more aesthetic appearance.

Figure 6:
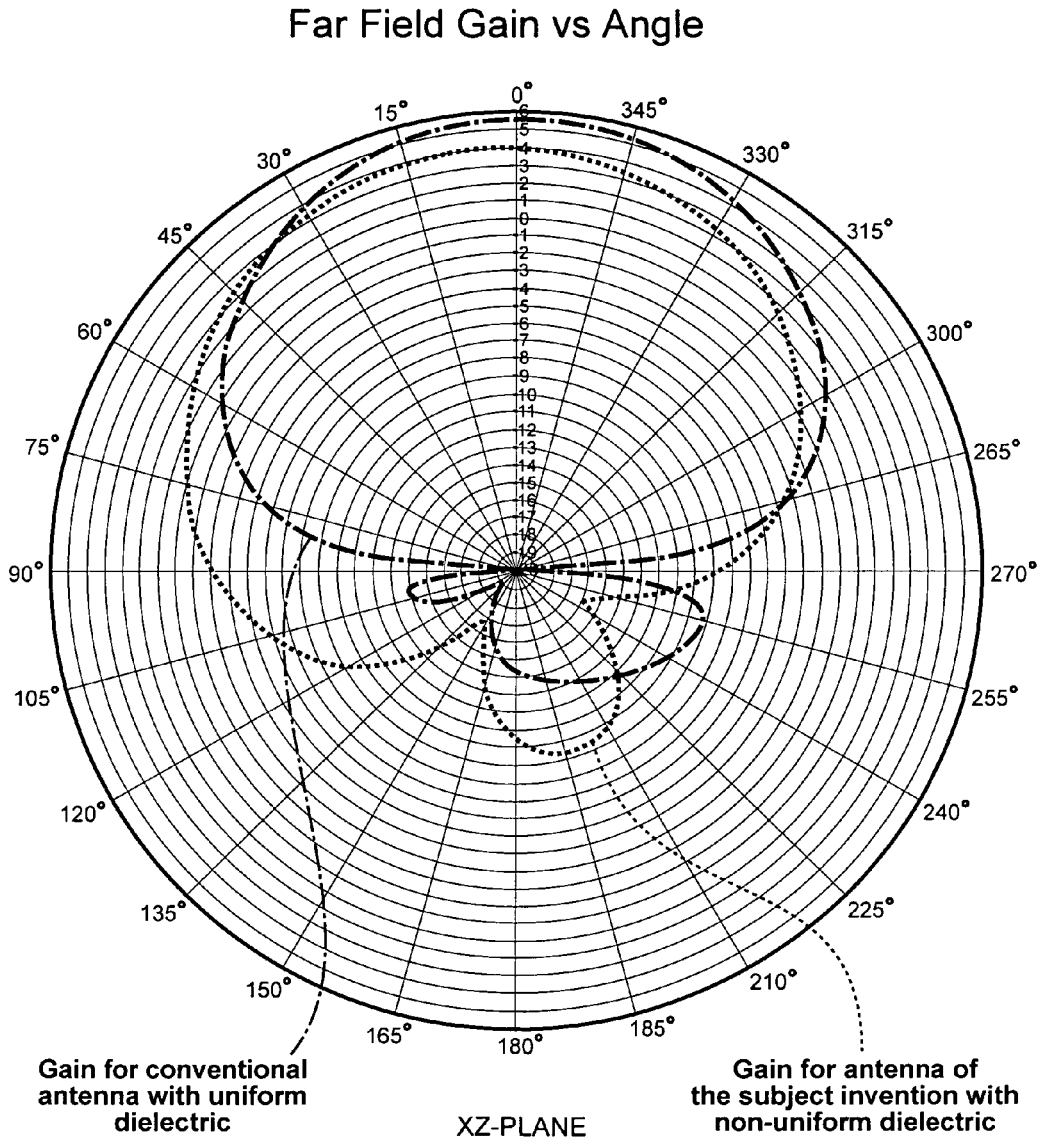
FIG. 6 is a chart entitled "Far Field Gain vs Angle" showing a tilt of a radiation beam of the present invention in an XZ-plane as compared to a conventional antenna with a single dielectric having a uniform relative permittivity.
Figure 7:
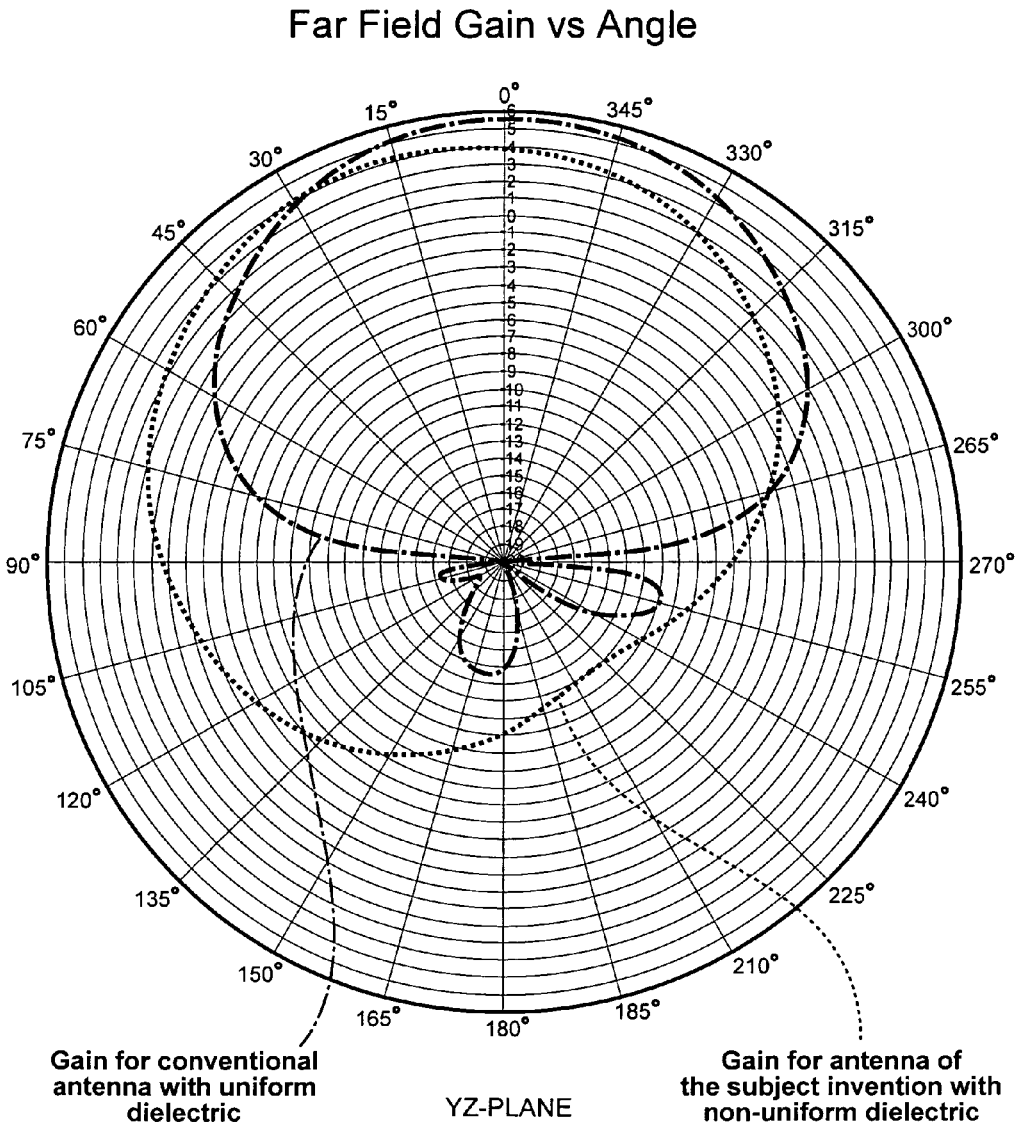
FIG. 7 is a chart entitled "Far Field Gain vs Angle" showing the tilt of the radiation beam of the present invention in a YZ-plane as compared to the conventional antenna of FIG. 5.

The tilt of the radiation beam is perhaps best understood by reviewing results of a computerized simulation of the antenna 10 of the preferred embodiment in comparison to a conventional antenna having a single dielectric with a uniform relative permittivity. FIG. 6 shows the radiation beam in an XZ-plane of the subject invention (denoted with a dotted line) as compared to the conventional antenna with the dielectric having a uniform relative permittivity (denoted with a dashed-and-dotted line). The radiation beam of the subject invention in the XZ-plane, including a highest gain portion of the radiation beam, is tilted by about 10° as compared to the radiation beam of the prior art. FIG. 7 shows the same radiation beam comparison, except now examining a YZ-plane. The radiation beam of the subject invention in the YZ-plane is tilted by about 20° as compared to the radiation beam of the prior art. As such, the antenna 10 according to the subject invention produces a higher gain for the RF signal received from the satellite at relatively low elevation angles than conventional uniform dielectric antennas.

The pane of glass 13 of the preferred embodiment, as mentioned above, acts as a dielectric. Therefore, the pane of glass 13 affects the radiation beam and other properties of the antenna 10. It is understood by those skilled in the art that the antenna 10 may be modified (or tuned) for similar performance in alternative embodiments where the antenna 10 does not include the pane of glass 13. These modifications include, but are not limited to, altering the dimensions of the radiation element 16, the feed line 30, and the perturbation truncations 22, and changing the relative permittivity of the first and second dielectrics 26, 28.

Multiple antennas 10 may be implemented as part of a diversity system of antennas 10. For instance, the vehicle 14 of the preferred embodiment may include a first antenna 10 on the windshield and a second antenna 10 on the backlite. These antennas 10 would both be electrically connected to a receiver (not shown) within the vehicle 14. A switch (not shown) may be implemented to select the antenna 10 that is currently receiving a stronger RF signal from the satellites.

Obviously, many modifications and variations of the present invention are possible in light of the above teachings. The invention may be practiced otherwise than as specifically described within the scope of the appended claims.

What is claimed is:

1. A window having an integrated antenna, said window comprising:

a pane of glass;

a radiation element supported by said pane of glass and having a first region and a second region;

a ground plane spaced from and disposed substantially parallel to said radiation element;

a first dielectric having a first relative permittivity and sandwiched between said first region and said ground plane;

a second dielectric having a second relative permittivity different from said first relative permittivity and sandwiched between said second region and said ground plane and disposed in a side-by-side relationship with said first dielectric; and a feed line for providing an electrical connection to said radiation element, wherein a section of said feed line is disposed between said first dielectric and said second dielectric.

2. A window as set forth in claim 1 wherein said first dielectric and said second dielectric are disposed to be in contact with one another.

3. A window as set forth in claim 1 wherein said feed line is directly connected to said radiation element.

4. A window as set forth in claim 1 wherein said feed line is electromagnetically coupled to said radiation element.

5. A window as set forth in claim 4 wherein said feed line is formed of an electrically conductive wire shaped to define a first section, a second section extending generally perpendicular from said first section, and a third section extending generally perpendicular from said second section and generally perpendicular to said first section.

6. A window as set forth in claim 5 wherein said second section is disposed between said first and second dielectrics.

7. A window as set forth in claim 6 wherein said first section is disposed within said first dielectric.

8. A window as set forth in claim 7 wherein said ground plane defines a hole and said third section of said feed line protrudes through said hole.

9. A window as set forth in claim 1 further comprising an amplifier electrically connected to said feed line for amplifying a signal received by said antenna.

10. A window as set forth in claim 9 further comprising a circuit board electrically connected to said feed line for supporting said amplifier.

11. A window as set forth in claim 10 wherein said circuit board is supported by said ground plane.

12. A window as set forth in claim 1 wherein a ratio of said second relative permittivity to said first relative permittivity is from 1:100 to 1:1.1.

13. A window as set forth in claim 1 wherein a ratio of said second relative permittivity to said first relative permittivity is from 100:1 to 1.1:1.

14. A window as set forth in claim 13 wherein said first dielectric comprises air having a first relative permittivity of 1.

15. A window as set forth in claim 14 wherein said second dielectric comprises silicone in an amount of 25 to 45 parts by weight and titanium oxide in an amount of 55 to 75 parts by weight, based on 100 parts by weight of the second dielectric.

16. A window as set forth in claim 14 wherein said second relative permittivity of said second dielectric is 9.

17. A window as set forth in claim 1 wherein said radiation element has a total area with said first region comprising about 80% of said total area and said second region comprising about 20% of said total area.

18. A window as set forth in claim 1 wherein said ground plane defines a generally rectangular shape.

19. A window as set forth in claim 1 wherein said radiation element defines a generally rectangular shape.

20. A window as set forth in claim 19 wherein said radiation element includes a pair of perturbation truncations defined at opposite corners of said radiation element for providing said radiation element with a circular polarization.

21. A window as set forth in claim 19 wherein each side of said radiation element measures about one-quarter of a wavelength $\lambda$ of a signal to be received by said antenna.

22. A window as set forth in claim 21 wherein each side of said radiation element measures about 32 mm.

23. A window as set forth in claim 1 wherein said first and second dielectrics are disposed to be in contact with said radiation element and said ground plane.

24. A window as set forth in claim 1 wherein said radiation element comprises a silver paste disposed on said pane of glass.

25. A window as set forth in claim 1 further comprising a cover affixed to said pane of glass for enclosing said ground plane, said radiation element, and said first and second dielectrics.

26. A window as set forth in claim 1 wherein said pane of glass is further defined as automotive glass.

27. A window as set forth in claim 26 wherein said pane of glass is further defined as soda-lime-silica glass.

28. A window as set forth in claim 1 wherein said pane of glass has a relative permittivity of 7.

29. An antenna comprising:

a radiation element having a first region and a second region;

a ground plane spaced from and disposed substantially parallel to said radiation element;

a first dielectric having a first relative permittivity and sandwiched between said first region and said ground plane;

a second dielectric having a second relative permittivity different from said first relative permittivity and sandwiched between said second region and said ground plane and disposed in a side-by-side relationship with said first dielectric; and a feed line for providing an electrical connection to said radiation element, wherein a section of said feed line is disposed between said first dielectric and said second dielectric.

30. An antenna as set forth in claim 29 wherein said first dielectric and said second dielectric are disposed to be in contact with one another.

31. An antenna as set forth in claim 29 wherein said feed line is directly connected to said radiation element.

32. An antenna as set forth in claim 29 wherein said feed line is electromagnetically coupled to said radiation element.

33. An antenna as set forth in claim 32 wherein said feed line is formed of an electrically conductive wire shaped to define a first section, a second section extending generally perpendicular from said first section, and a third section extending generally perpendicular from said second section and generally perpendicular to said first section.

34. An antenna as set forth in claim 33 wherein said second section is disposed between said first and second dielectrics.

35. An antenna as set forth in claim 34 wherein said first section is disposed within said first dielectric.

36. An antenna as set forth in claim 35 wherein said ground plane defines a hole and said third section of said feed line protrudes through said hole.

37. An antenna as set forth in claim 29 further comprising an amplifier electrically connected to said feed line for amplifying a signal received by said antenna.

38. An antenna as set forth in claim 37 further comprising a circuit board electrically connected to said feed line for supporting said amplifier.

39. An antenna as set forth in claim 38 wherein said circuit board is supported by said ground plane.

40. An antenna as set forth in claim 29 wherein a ratio of said second relative permittivity to said first relative permittivity is from 1:100 to 1:1.1.

41. An antenna as set forth in claim 29 wherein a ratio of said second relative permittivity to said first relative permittivity is from 100:1 to 1.1:1.

42. An antenna as set forth in claim 41 wherein said first dielectric comprises air having a first relative permittivity of 1.

43. An antenna as set forth in claim 42 wherein said second dielectric comprises silicone in an amount of 25 to 45 parts by weight and titanium oxide in an amount of 55 to 75 parts by weight, based on 100 parts by weight of the second dielectric.

44. An antenna as set forth in claim 43 wherein said second relative permittivity of said second dielectric is 9.

45. An antenna as set forth in claim 29 wherein said radiation element has a total area with said first region comprising about 80% of said total area and said second region comprising about 20% of said total area.

46. An antenna as set forth in claim 29 wherein said ground plane defines a generally rectangular shape.

47. An antenna as set forth in claim 29 wherein said radiation element defines a generally rectangular shape.

48. An antenna as set forth in claim 47 wherein said radiation element includes a pair of perturbation truncations defined at opposite corners of said radiation element for providing said radiation element with a circular polarization.

49. An antenna as set forth in claim 47 wherein each side of said radiation element measures about one-quarter of a wavelength $\lambda$ of a signal to be received by said antenna.

50. An antenna as set forth in claim 49 wherein each side of said radiation element measures about 32 mm.

51. An antenna as set forth in claim 29 wherein said first and second dielectrics are disposed to be in contact with said radiation element and said ground plane.

52. An antenna as set forth in claim 29 further comprising a pane of glass supporting said radiation element.

53. An antenna as set forth in claim 52 wherein said pane of glass is further defined as automotive glass.

54. An antenna as set forth in claim 53 wherein said pane of glass is further defined as soda-lime-silica glass.

55. An antenna as set forth in claim 52 wherein said radiation element comprises a silver paste disposed on said pane of glass.

56. An antenna as set forth in claim 52 further comprising a cover affixed to said pane of glass for enclosing said ground plane, said radiation element, and said first and second dielectrics.

* * * * *